US005362439A

United States Patent [19]

Bletton et al.

[11] Patent Number: 5,362,439

[45] Date of Patent: Nov. 8, 1994

[54] AUSTENITIC STAINLESS STEEL HAVING A HIGH MACHINABILITY AND AN IMPROVED COLD DEFORMATION

[75] Inventors: Olivier Bletton, Ugine; Xavier Cholin, Albertville, both of France

[73] Assignee: Ugine Savoie, Ugine, France

[21] Appl. No.: 46,941

[22] Filed: Apr. 16, 1993

[30] Foreign Application Priority Data

Apr. 17, 1992 [FR] France ..... 92 04810

[51] Int. Cl.[5] ..... C22C 38/42

[52] U.S. Cl. ..... 420/41; 420/49

[58] Field of Search ..... 420/41, 49

[56] References Cited

U.S. PATENT DOCUMENTS 3,282,684 11/1966 Allen .
3,282,686 11/1966 Allen .

FOREIGN PATENT DOCUMENTS 0403332 12/1990 European Pat. Off. .
2228119 11/1974 France .
2721998 12/1977 Germany .
61-139651 6/1986 Japan ..... 420/41
2177113 1/1987 United Kingdom .

*Primary Examiner*—Deborah Yee
*Attorney, Agent, or Firm*—Oblon, Spivak, McClelland, Maier & Neustadt

[57] ABSTRACT

The weldable austenitic stainless steel having a high machinability and an improved cold deformation has the following composition by weight: C less than 0.1%; Si less than 2%; Mn less than 2%; S less than 0.03%; Ni between 8 and 10%; Cr between 15 and 25%; P less than or equal to 0.04%; Mo less than 0.5%; Cu between 1 and 5%; N between 0.02 and 0.07%; Ca more than $30.10^{31\ 4}$%; 0 more than $70.10^{-4}$%; Al less than $50.10^{-4}$%; the ratio Ca/O being between 0.3 and 0.6.

12 Claims, 3 Drawing Sheets

Figure 1:
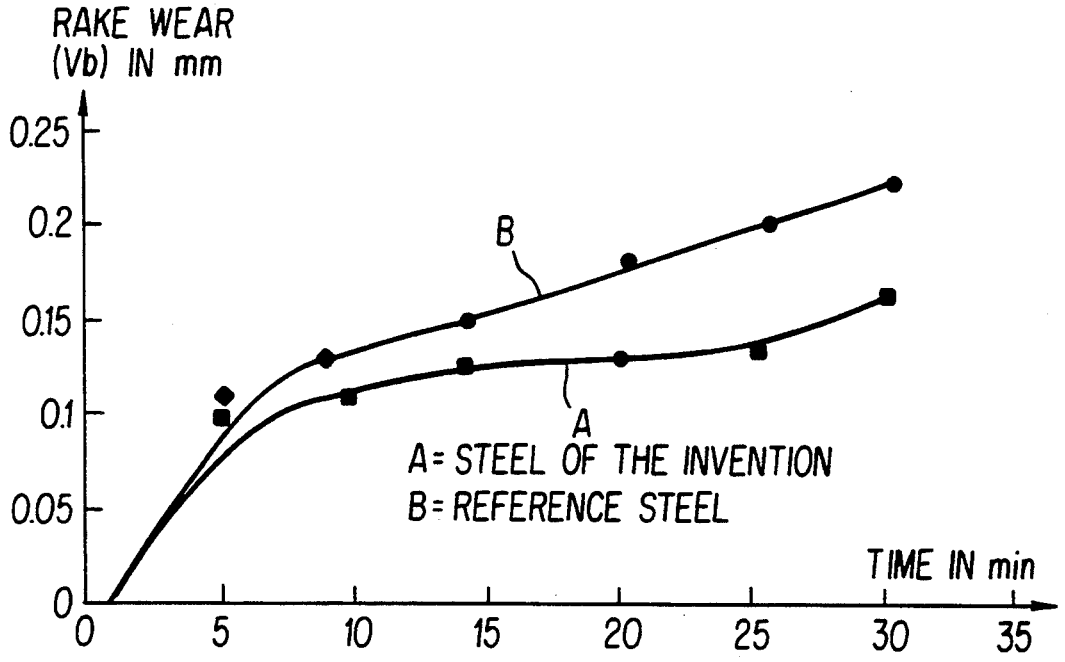

AUSTENITIC STAINLESS STEEL HAVING A HIGH MACHINABILITY AND AN IMPROVED COLD DEFORMATION

The present invention relates to a weldable austenitic stainless steel which is highly machinable and has good cold deformation characteristics.

There is known from JP-A-160 785 a machinable steel which is cold deformable and has in its composition by weight, in particular a sulphur content less than 0.03%, calcium and oxygen contents respectively between 10 and 300 ppm and between 30 and 300 ppm, a copper content between 0.8 and 5% and a lead content between 0.01 and 0.25%.

Oxygen and calcium are introduced in this austenitic stainless steel to convert the hard inclusions into calcium oxide-base inclusions.

The improvement in the machinability results from the introduction in the composition of a variable quantity of lead.

It is well known that the austenitic stainless steels are difficult to machine, on one hand, owing to their low thermal conductivity and, on the other hand, owing to their high work hardenability which results locally in high hardness zones. A poor flow of the heat produced at the point of the cutting tool results in a rapid deterioration of the tool.

One means of improving the machinability of austenitic stainless steel, according to patent JP-A-160 785, consists in introducing the lead element in a proportion of between 0.01 and 0.25%.

This element has the drawbacks of being difficult to dissolve in a homogeneous manner in a bath of molten metal and, owing to its high density, of having a tendency to accumulate at the bottom of the metallurgical vessels.

Further, it forms phases having a low melting point which deteriorate the hot deformability by formation of defects upon rolling and which, as concerns weldability, produce in the weld zone this same defect which limits the mechanical resistance of the weld.

Moreover, boron may be introduced in the composition of the austenitic stainless steel, according to patent JP-A-160 785, as an element capable of counteracting the harmful effects of the lead as concerns hot rolling, but boron still further increases the welding difficulties.

The introduction of the boron element moreover results in at least one other drawback, namely it reduces the range of temperature suitable for hot rolling, which requires a more demanding hot rolling process.

The austenitic stainless steel, according to patent JP-A-160 785, may also contain titanium.

Now, titanium which is usually introduced in stainless steels to improve resistance to intergranular corrosion, disturbs the formation of calcium oxide inclusions and reduces the number thereof.

Further, titanium results in the formation of hard inclusions which reduce the machinability by causing premature wear of the cutting tools.

A method for manufacturing a highly machinable steel is also known from patent FR-A-2 542 761.

In this document, it is mentioned that a cause of the difficulty of machining stainless steels resides in the fact that they contain hard oxide inclusions, such as for example alumina or chromite which deteriorate the cutting tools.

One means of reducing the harmful effect of hard oxide inclusions is to introduce in the steel one or more alkaline earth compounds so as to replace in a good proportion the hard inclusions by calcium-base oxide inclusions for example. It is also mentioned, on one hand, that a certain amount of sulphur combined with hard inclusions reduces the harmful effect of the latter, the sulphur content being generally less than $0.5.10^{-4}$% and, on the other hand, that another means of reducing the harmful effect of the inclusions is to reduce their amount by a good deoxidation and a good decantation of the bath of molten metal during the preparation of the steel.

In patent FR-A-2 648 477, it is proposed for the purpose of improving the machinability of austenitic stainless steels, to introduce in the composition an amount of sulphur in a proportion of between 0.1 and 0.4% while ensuring a proportion of calcium and oxygen respectively higher than $30.10^{-4}$% and $70.10^{-4}$% and satisfying the relation Ca/O of between 0.2 and 0.6.

In this document, the purpose is to form, with the manganese and in a smaller proportion with the chromium, a manganese and chromium sulphur (Mn, Cr) S which affords in the form of specific inclusions a solid lubrication of the cutting tool during the machining operations.

It is also mentioned that the sulphur has an unfavourable effect on the resistance to corrosion and that, despite this, a chosen orientation is the introduction in the resulphurized steel of silicoaluminate of lime oxides and preferably anorthite.

Now, the applicant has noticed that such an austenitic stainless steel, while having good machinability properties, has another drawback. Indeed, the sulphur reduces in a consequential manner the properties of the steels from the point of view of weldability and the point of view of cold deformation with occurrence of cracks for example in wire drawing.

In the previously-mentioned documents, the machinability of austenitic stainless steel is therefore improved:

- by the introduction of lead as a lubricant,
- by the introduction of oxygen or calcium to replace the hard inclusions by inclusions based on alkaline earth compounds,
- by the reduction of the number of hard inclusions by the deoxidation of the bath of molten metal during the preparation of the steel,
- by the introduction of an amount of sulphur by a resulphurizing technique.

An object of the present invention is to provide a weldable austenitic stainless steel having an improved machinability and good cold characteristics, in which the simultaneous presence in a suitable proportion of copper and malleable oxides, chosen from a ternary diagram $Al_2O_3$—$SiO_2$—CaO, very substantially improves a group of properties some of which are antinomic. The austenitic stainless steel according to the present invention is characterized in that its composition by weight is the following:

C less than 0.1%
Si less than 2%
Mn less than 2%
S less than 0.03%
Ni between 8 and 10%
Cr between 15 and 25%
P less than or equal to 0.04%
Mo less than 0.5%
Cu between 1 and 5%

N between 0.02 and 0.07%
Ca more than $30.10^{4}$%
O more than $70.10^{-4}$%
Al less than $50.10^{-4}$%,
the ratio Ca/O being between 0.3 and 0.6.

The austenitic stainless steel according to the present invention preferably has the following composition by weight:

C less than or equal to 0.08%
Si between 0.2 and 0.75%
Mn between 0.5 and 1.5%
S less than 0.03%
Ni between 8 and 10%
Cr between 17 and 19%
Mo less than 0.5%
Cu between 3 and 4%
N between 0.02 and 0.07%
Ca between 0,003 and 0.01%
O between 0.007 and 0.02%
Al less than 0.005%
P less than or equal to 0.04%,
the ratio Ca/O being between 0.3 and 0.6.

The weldable austenitic stainless steel which is highly machinable and has a good cold deformability, contains malleable oxides the compositions of which are in the ternary diagram $Al_2O_3$—$SiO_2$—CaO in the zone of the triple point anorthite, gehlenite, pseudo-wollastonite.

The sulphur ensures the formation of microprecipitates of manganese sulphur and the copper ensures a reduction in the work hardenability permitting the obtainment of a less hard surface and, in the course of machining, the formation of chips which are also less hard at the machining temperature, whence a big increase in the life of the tools.

In a preferred form of the invention, the nitrogen concentration is between 0.03 and 0.05%. In another preferred form of the invention, the carbon concentration is less than 0.03%.

Figure 2:
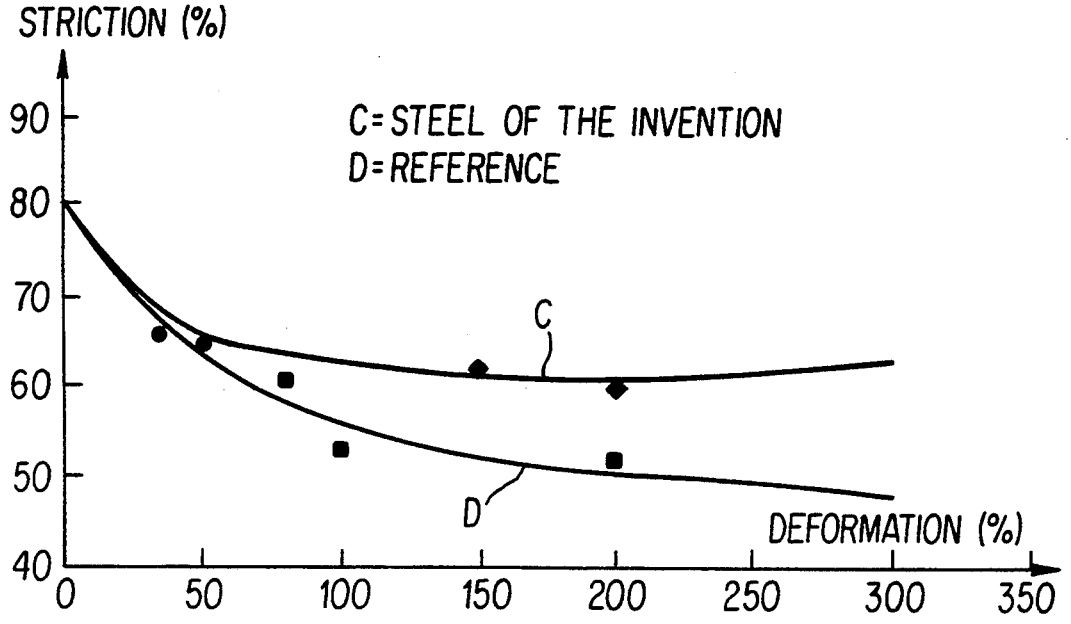
Figure 3:
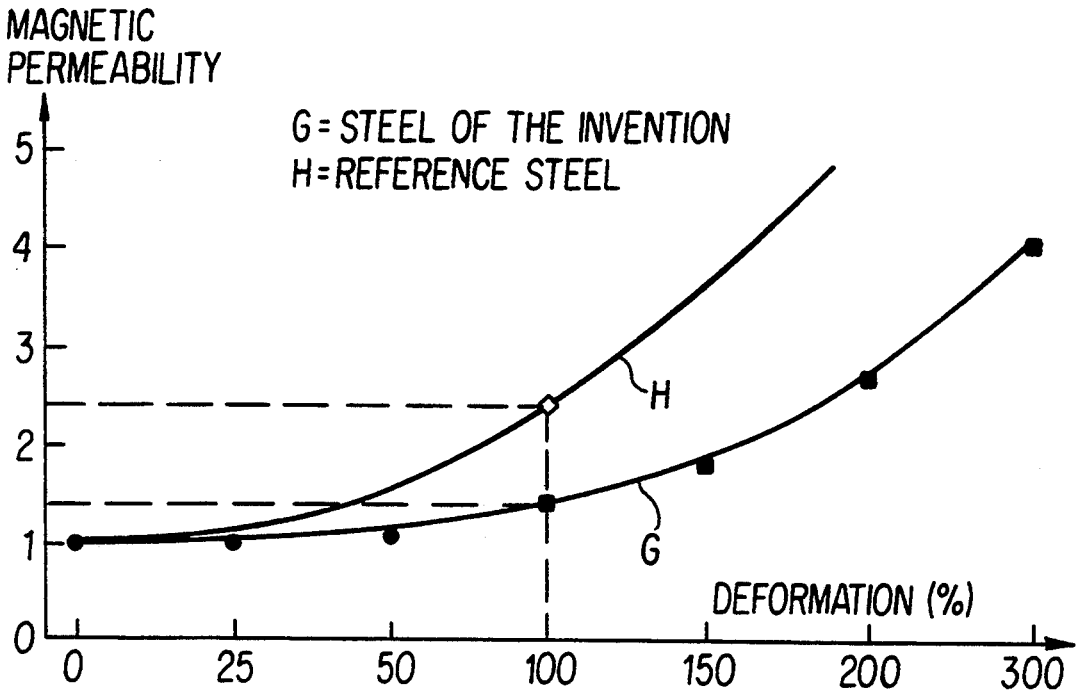
Figure 4:
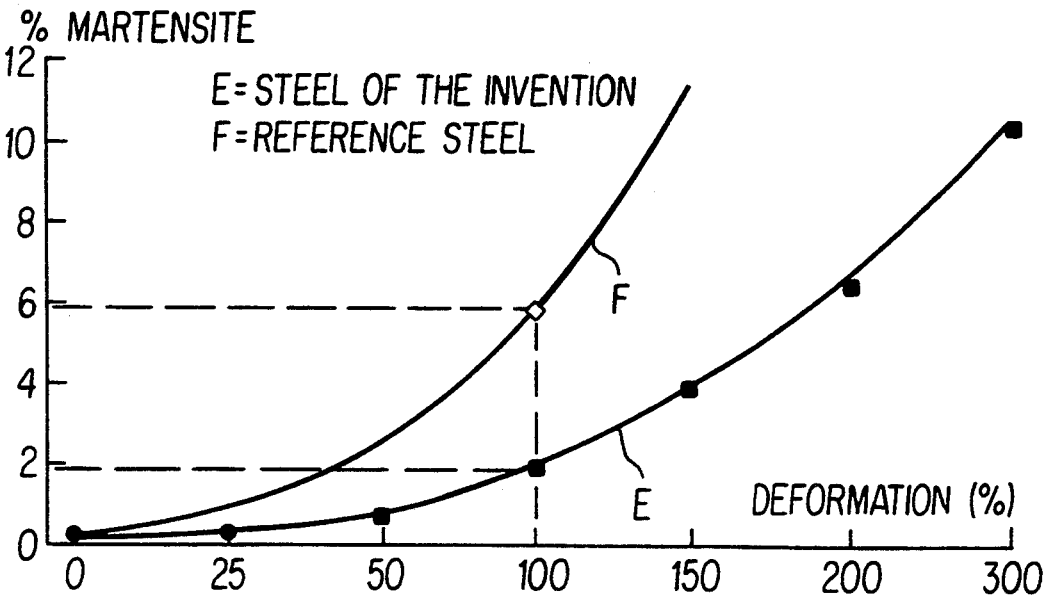
Figure 5:
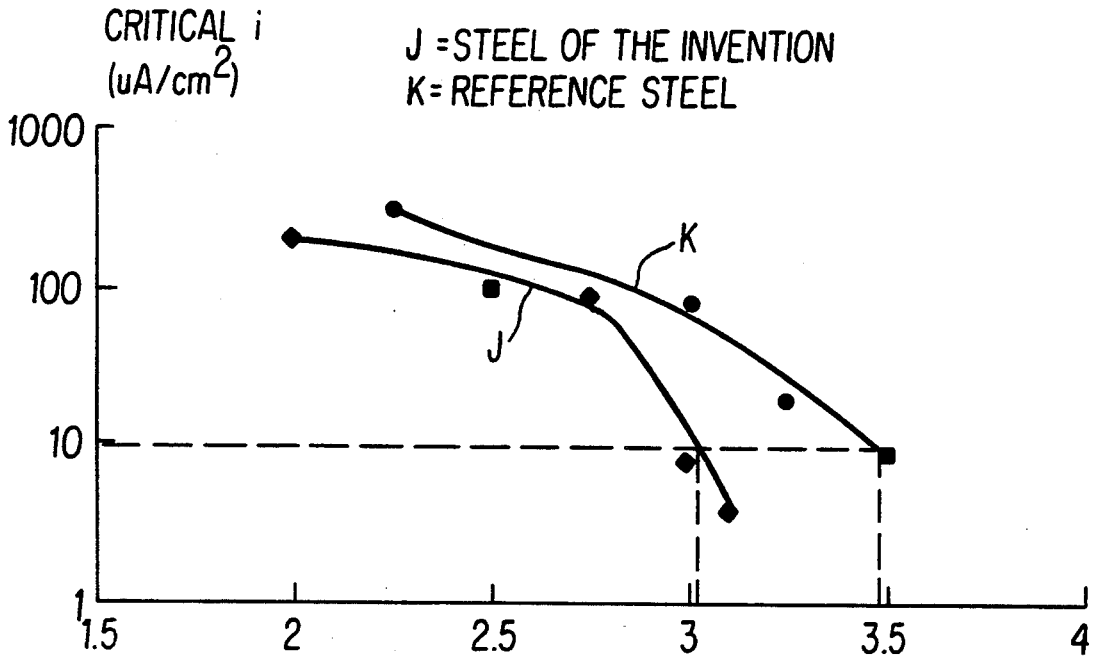

Features and advantages of the invention will be apparent from the following description which is given solely by way of example with reference to the accompanying drawings, in which:

FIG. 1 represents two curves of the evolution of the wear of a tool as a function of time in respect of a steel according to the invention and a reference steel, FIG. 2 represents two curves showing the evolution of the coefficient of striction after wire drawing in respect of a steel according to the invention and a reference steel, FIGS. 3 and 4 represent, on one hand, a compared evolution of the magnetic permeability as a function of the percentage of deformation of a steel according to the invention and a reference steel, and, on the other hand, the evolution of the martensite concentration as a function of the percentage of deformation in respect of the steel according to the invention and the same reference steel, FIG. 5 represents two curves showing the magnitude of the critical current as a function of the pH in a corrosion test in a chlorinated medium in respect of the steel according to the invention compared with a reference steel.

The composition by weight of the austenitic stainless steel according to the present invention is the following:

C less than 0.1%
Si less than 2%
Mn less than 2%
S less than 0.03%
Ni between 8 and 10%
Cr between 15 and 25%
P less than or equal to 0.04%
Mo less than 0.5%
Cu between 1 and 5%
N between 0.02 and 0.07%
Ca more than $30.10^{-4}$%
O more than $70.10^{-4}$%
Al less than $50.10^{-4}$%,
the ratio Ca/O being between 0.3 and 0.6.

Preferably, the composition by weight of the austenitic stainless steel according to the present invention is the following:

C less than or equal to 0.08%
Si between 0.2 and 0.75%
Mn between 0.5 and 1.5%
S less than 0.03%
Ni between 8 and 10%
Cr between 17 and 19%
Mo less than 0.5%
Cu between 3 and 4%
N between 0.02 and 0.07%
Ca between 0.003 and 0.01%
O between 0.007 and 0.02%
Al less than 0.005%
P less than or equal to 0.04%,
the ratio Ca/O being between 0.3 and 0.6.

This steel contains malleable oxides the compositions of which are in the ternary diagram $Al_2O_3$—$SiO_2$—CaO in the zone of the triple point anorthite, gehlenite and pseudo-wollastonite.

Up to the present time, the machinability of austenitic stainless steels is improved by introducing in the composition of the steels either lead, sulphur, or a controlled amount of calcium and oxygen.

Now, the applicant has noticed that, surprisingly, the combination of the copper, oxygen and calcium elements associated with a small amount of sulphur imparts a remarkable machinability to the austenitic stainless steel.

The copper element has for effect:

to reduce the hardness of the chips at the machining temperature,
as concerns cold deformation, to ensure a reduction in the work hardenability of the steel by an increase in the energy of the piling defects,
and to ensure a resistance to corrosion in an acid medium by formation of a protective film of metallic oxide.

The nitrogen element introduced in the composition of the austenitic stainless steels in a predetermined proportion and limited between 0.03 and 0.05% stabilizes the austenite at the expense of the formation of the work hardening martensite which tends to reduce the magnetic permeability.

Preferably, the carbon concentration is less than 0.03%.

The applicant has also noticed that the copper element replacing the sulphur and the lead used alone and preferably with nitrogen, contributes to the stabilization of the austenite at the expense of the formation of work hardening martensite, which results in a reduction in the magnetic permeability.

Austenitic stainless steel according to the invention has a group of characteristics and physical properties which are sometimes surprising, sometimes antinomic, such as machining, welding, cold deformation, amagnetism and resistance to corrosion.

Among these characteristics and physical properties, there will be hereinafter described in succession a series of comparative tests, such as a test of the wear of a carbide tool as a function of time, a comparative test of the cold-deformability by wire drawing, a comparative test of the physical properties of malleability related to the formation of martensite in the steel, a comparative test of the resistance to cavernous corrosion, and a weldability test.

In the domain of austenitic stainless steels having an improved machinability, the different technical orientations and properties of use obtained are generally compared with an international reference steel AISI 304.

This reference steel is a classified austenitic steel the general composition of which is the following: C less than 0.08%, Cr between 18 and 20%, Ni between 8 and 10.5%, S less than 0.03%, Mo less than or equal to 0.5%, Mn less than or equal to 2% and N less than or equal to 0.1%.

In the domain of the machining of austenitic stainless steels, tests have been carried out with carbide tools.

It will be observed from FIG. 1 that, after 30 minutes of machining, with a cutting speed of 220 m/min, the rake wear Vb of the tool having machined the steel according to the invention (curve A) is reduced by about 30% with respect to the rake wear Vb obtained after machining the reference steel (curve B).

The steel according to the invention was also tested in the "Gun Drilling" technology, i.e. drilling with a guide bushing and under oil at high pressure. The choice of the cutting conditions for a good evacuation of the chips having been achieved, the machining of the steel pieces according to the invention is four times faster than with a reference steel and the number of machined pieces before resharpening the tool is six times higher.

From the point of view of cold deformability, the tests shown in FIG. 2 show that, after a 300% deformation by wire drawing, the steel according to the invention (curve C) conserves a coefficient of striction higher than 60% whereas it reaches a value lower than 50% with a reference steel (curve D).

One of the original physical characteristics is related to the magnetic behaviour of the steel according to the invention, as revealed in a comparative test represented in FIGS. 3 and 4.

After a 100% deformation by wire drawing, the steel according to the invention has a magnetic permeability of 1.4 (curve G, FIG. 3) and, in the course of the wire drawing, only 1.9% martensite is formed (curve E, FIG. 4).

Under the same conditions, the reference steel forms three times as much martensite (curve F, FIG. 4) and consequently has a magnetic permeability of 2.4 (curve H, FIG. 3).

Tests of the resistance to corrosion were also carried out and are shown in FIG. 5.

The depassivation pH, measured in a solution of sodium chloride and defined by the pH beyond which the critical passivation current is lower than 10 $\mu A/cm^2$, is substantially equal to 3 with the steel according to the invention (curve J) and distinctly lower than that of the reference steel which is 3.5 (curve K).

As concerns weldability, a test was carried out by comparing two arc welds without filler metal, one being formed between the reference steel and a resulphurized steel, the other between the same reference steel and a steel according to the invention.

There was observed in a thermally affected zone of the resulphurized steel, a high precipitation of sulphur in the grain joints.

This zone was compared with a zone non-thermally affected and it was found that this non-thermally affected zone has the known sulphur inclusions of such a resulphurized steel.

Upon examination of the weld formed between the reference steel and the steel according to the invention, it was observed that the steel according to the invention has no modification of structure due to the welding.

The different characteristics mentioned hereinbefore impart to the steel according to the invention a high-speed machinability, a cold deformability having remarkable magnetic properties and a high cavernous corrosion resistance together with weldability.

The combination of the copper element associated with a small amount of sulphur and a given proportion of calcium and oxygen imparts to the steel according to the invention remarkable characteristics without resulting in the drawbacks inherent in elements having low melting points.

What is claimed is:

1. Weldable austenitic stainless steel exhibiting a high machinability and an improved cold deformation and having the following composition by weight:

C less than 0.1%
Si less than 2%
Mn less than 2%
S less than 0.03%
Ni between 8 and 10%
Cr between 15 and 25%
P at the most equal to 0.04%
Mo less than 0.5%
Cu between 1 and 5%
N between 0.02 and 0.07%
Ca more than $30.10^{-4}$%
O more than $70.10^{-4}$%
Al less than $50.10^{-4}$%,
the ratio Ca/O being between 0.3 and 0.6.

2. Steel according to claim 1, having the following composition by weight:

C less than or equal to 0.08%
Si between 0.2 and 0.75%
Mn between 0.5 and 1.5%
S less than 0.03%
Ni between 8 and 10%
Cr between 17 and 19%
Mo less than 0.5%
Cu between 3 and 4%
N between 0.02 and 0.07%
Ca between 0.003 and 0.01%
O between 0.007 and 0.02%
Al less than 0.005%
P at the most equal to 0.04%,
the ratio Ca/O being between 0.3 and 0.6.

3. Steel according to claim 1, containing malleable oxides the compositions of which are on the ternary diagram $Al_2O_3$—$SiO_2$—CaO in the zone of the triple point anorthite, gehlenite and pseudo-wollastonite.

4. Steel according to claim 2, containing malleable oxides the compositions of which are on the ternary diagram $Al_2O_3$—$SiO_2$—CaO in the zone of the triple point anorthite, gehlenite and pseudo-wollastonite.

5. Steel according to claim 1, wherein the concentration of nitrogen is between 0.03 and 0.05%.

6. Steel according to claim 2, wherein the concentration of nitrogen is between 0.03 and 0.05%.

7. Steel according to claim 3, wherein the concentration of nitrogen is between 0.03 and 0.05%.

8. Steel according to claim 4, wherein the concentration of nitrogen is between 0.03 and 0.05%.

9. Steel according to claim 1, wherein the concentration of carbon is less than 0.03%.

10. Steel according to claim 2, wherein the concentration of carbon is less than 0.03%.

11. Steel according to claim 3, wherein the concentration of carbon is less than 0.03%.

12. Steel according to claim 4, wherein the concentration of carbon is less than 0.03%.

* * * * *